US009579005B2

(12) United States Patent
Graves et al.

(10) Patent No.: US 9,579,005 B2
(45) Date of Patent: Feb. 28, 2017

(54) PORTABLE HOSPITAL CLEANING APPARATUS

(71) Applicant: XANITOS, INC., Newtown Square, PA (US)

(72) Inventors: Brian Keith Graves, Bakersfield, CA (US); Crispin Mercado, Bakersfield, CA (US)

(73) Assignee: Xanitos, Inc., Newtown Square, PA (US)

( * ) Notice: Subject to any disclaimer, the term of this patent is extended or adjusted under 35 U.S.C. 154(b) by 722 days.

(21) Appl. No.: 13/959,905

(22) Filed: Aug. 6, 2013

(65) Prior Publication Data

US 2014/0048106 A1 Feb. 20, 2014

Related U.S. Application Data

(60) Provisional application No. 61/684,246, filed on Aug. 17, 2012.

(51) Int. Cl.

| | |
|---|---|
| ***A47L 9/00*** | (2006.01) |
| ***A47L 9/10*** | (2006.01) |
| ***A47L 5/22*** | (2006.01) |

(52) U.S. Cl.

CPC ..... *A47L 9/009* (2013.01); *A47L 5/22* (2013.01); *A47L 9/10* (2013.01)

(58) Field of Classification Search

CPC ... B08B 5/04; A47L 9/009; A47L 9/10; A47L 9/0009; A47L 9/0027; A47L 9/127; A47L 9/1683; A47L 5/28

See application file for complete search history.

(56) References Cited

U.S. PATENT DOCUMENTS

| | | | | |
|---|---|---|---|---|
| 3,627,584 | A * | 12/1971 | Stewart | D01H 11/005 134/21 |
| 3,812,370 | A * | 5/1974 | LaViolette | F24F 13/28 422/186.12 |
| 4,123,201 | A | 10/1978 | Andriulis | |
| 4,810,269 | A | 3/1989 | Stackhouse et al. | |
| 4,968,333 | A | 11/1990 | Ellis et al. | |
| 5,069,691 | A | 12/1991 | Travis et al. | |
| 5,433,763 | A * | 7/1995 | Shagott | A47L 5/38 55/323 |
| 5,524,321 | A | 6/1996 | Weaver et al. | |
| 5,588,985 | A | 12/1996 | Shagott et al. | |
| 5,853,441 | A * | 12/1998 | Groen | B01D 46/02 55/350.1 |
| 6,308,374 | B1 | 10/2001 | Bobrosky et al. | |
| 6,553,610 | B1 | 4/2003 | Shideler | |
| 6,785,932 | B2 | 9/2004 | Bone | |
| 6,804,857 | B1 | 10/2004 | Olewiler | |
| 6,979,359 | B2 * | 12/2005 | Laiti | B01D 46/0023 454/187 |
| 7,690,077 | B2 | 4/2010 | Biere | |
| 8,122,566 | B2 | 2/2012 | Sepke et al. | |
| 8,161,599 | B2 | 4/2012 | Griffith et al. | |
| 2011/0284026 | A1 | 11/2011 | Taylor | |

* cited by examiner

*Primary Examiner* — Dung Van Nguyen
(74) *Attorney, Agent, or Firm* — Baker & Hostetler LLP

(57) ABSTRACT

The present inventions are directed to portable cleaning apparatuses adapted for use on mobile cleaning carts useable, for example, for cleaning hospital rooms. Each apparatus comprises a pre-filter module, a vacuum source module, and a secondary filter module, releasably securable to one another, the entire apparatus being configured provide high efficiency cleaning at low noise levels.

32 Claims, 4 Drawing Sheets

PORTABLE HOSPITAL CLEANING APPARATUS

CROSS REFERENCE TO RELATED APPLICATIONS

This Application claims the benefit of U.S. Provisional Application Ser. No. 61/684,246, filed Aug. 17, 2012, which is incorporated by reference in its entirety.

TECHNICAL FIELD

This invention relates to portable hospital cleaning apparatus, especially those apparatus comprising compact modular vacuum equipped cleaning apparatus useful for cleaning hospital room environments.

BACKGROUND

Traditional methods for cleaning institutional spaces, generally, and a patient's area in a medical facility, specifically, include dry mopping and dusting. Such methods can disperse dust particulates throughout the patient's environment, decreasing air quality. The dust particulates also resettle and contaminate surfaces thought to be clean. Airborne dust could also be breathed by the patient, leading to infections and lowering health quality. Traditional cleaning methods have also included mopping floors using a bucket that is moved from room to room without changing or refreshing the cleaning solution. This approach can lead to cross contamination of bacteria from one room to the next.

Portable mobile carts are available for use in cleaning hospital environments. In some cases, these portable carts may include a shelf for a portable vacuum cleaner. These portable vacuum cleaners take up valuable space otherwise useful for carrying other cleaning supplies.

There is a need for vacuum cleaning systems which can be mounted or contained with mobile cleaning carts and provide a much smaller spatial footprint, while maintaining the high efficiency cleaning and acoustical performance needed for use in institutional, including hospital, environments.

SUMMARY

The present invention(s) are directed to portable cleaning apparatuses adapted for use on mobile cleaning carts, each apparatus comprising:

(a) a vacuum source module comprising a vacuum power unit positioned within an air leak-resistant vacuum source module housing, said vacuum source module housing having an inlet portal and an outlet portal;

(b) a pre-filter module comprising a primary particle container positioned within an air-leak resistant pre-filter module housing, said pre-filter module housing having a debris intake port and an outlet port, said primary particle container being releasably attached to the debris intake port, and said outlet port of the pre-filter module housing being disposed in fluid communication, preferably direct fluid communication, with the inlet portal of the vacuum source module;

(c) a secondary filter module comprising a secondary filter positioned within an air leak-resistant secondary filter module housing having an inlet aperture and an outlet aperture, the inlet aperture of said secondary filter module housing being disposed in fluid communication, preferably direct fluid communication, with the outlet portal of said vacuum source module housing so that air is directed to flow from the outlet portal of the vacuum source module housing through the inlet aperture of the secondary filter housing;

(d) the pre-filter module and the vacuum source module being releasably securable to one another; and (e) the vacuum source module and the secondary filter module being releasably securable to one another; and when the (a), (b), and (c) modules are secured together as in (d) and (e), said apparatus, being configured to provide a filtering airflow path, such that an air stream entraining debris, dust and contaminants is directed sequentially through the debris intake port, the primary particle container, the outlet port of the pre-filter module, the inlet and outlet portals of the vacuum source module housing, and the inlet and outlet apertures of the secondary filter module housing; and the apparatus, when energized, providing an A-weighted sound power level of less than about 75 dB, when measured at a distance of 6 feet using a methodology described in ASTM F1334-12.

Other embodiments include mobile vacuum cart systems, each mobile cart system comprising one of these portable cleaning apparatuses.

Still other embodiments include those methods of cleaning an institutional space, including a hospital room, comprising vacuuming said room with one of these portable cleaning apparatuses or cart systems.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. In addition, the drawings are not necessarily drawn to scale. In the drawings.

DETAILED DESCRIPTION OF ILLUSTRATIVE EMBODIMENTS

Figure 1:
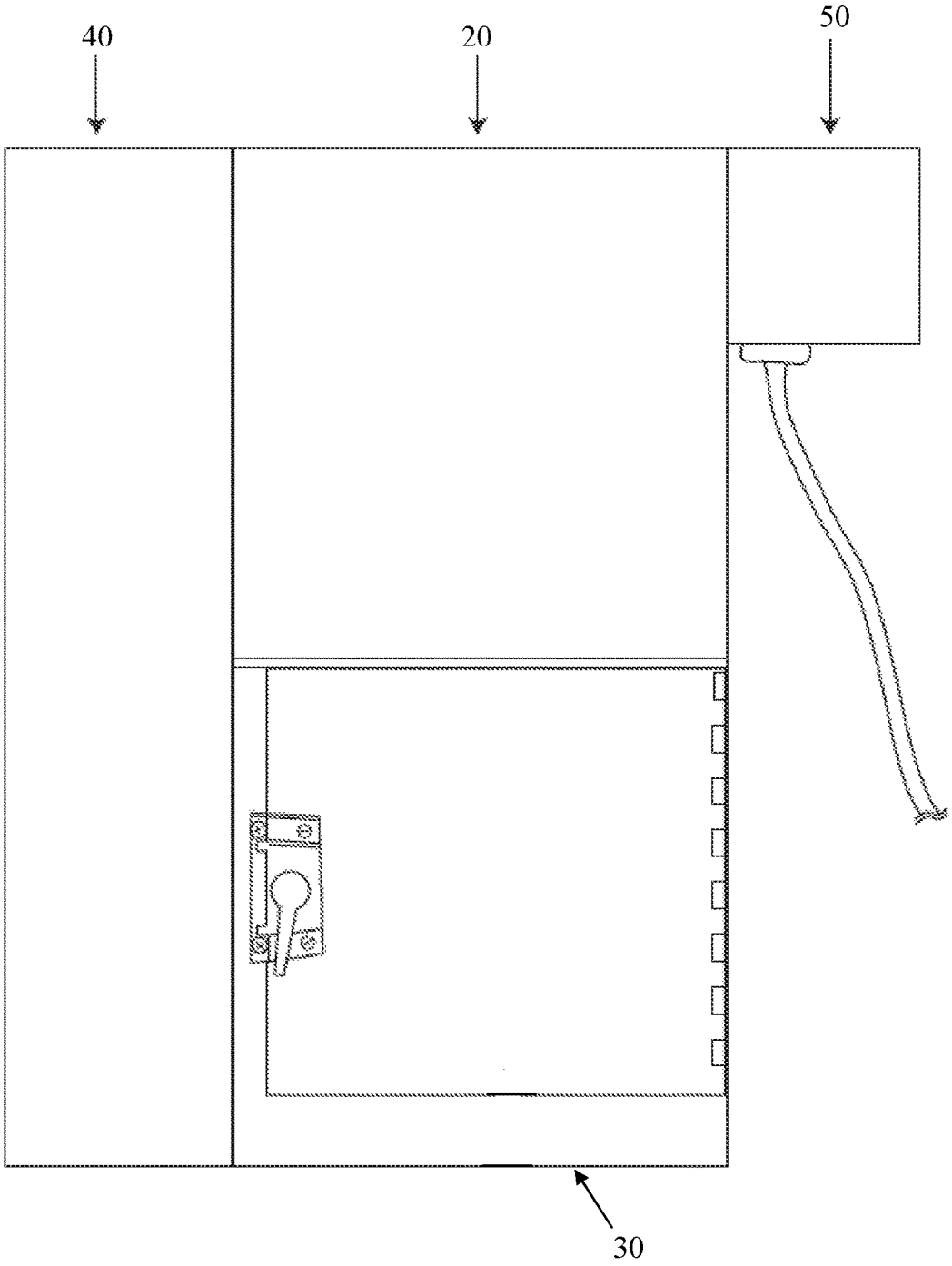
FIG. 1 shows a side view of one embodiment of an assembled vacuum apparatus of the present invention, showing the vacuum source module 20, pre-filter module 30, secondary filter module 40, and control box module 50.

The present invention may be understood more readily by reference to the following description taken in connection with the accompanying Figures and Examples, all of which form a part of this disclosure. It is to be understood that this invention is not limited to the specific products, methods, conditions or parameters described and/or shown herein, and that the terminology used herein is for the purpose of describing particular embodiments by way of example only and is not intended to be limiting of any claimed invention. Similarly, unless specifically otherwise stated, any description as to a possible mechanism or mode of action or reason for improvement is meant to be illustrative only, and the invention herein is not to be constrained by the correctness or incorrectness of any such suggested mechanism or mode of action or reason for improvement. Throughout this text, it is recognized that the descriptions refer both to the features and methods of operating a cleaning apparatus, in the absence and in conjunction with mobile cleaning carts. That is, where the disclosure describes and/or claims a particular apparatus, it is appreciated that these descriptions and/or claims also describe and/or claim the methods associated with the assembly, disassembly, and use of such an apparatus, both when standing alone and when mounted on a mobile cleaning cart.

In the present disclosure the singular forms "a," "an," and "the" include the plural reference, and reference to a particular numerical value includes at least that particular value, unless the context clearly indicates otherwise. Thus, for example, a reference to "a material" is a reference to at least one of such materials and equivalents thereof known to those skilled in the art, and so forth.

When a value is expressed as an approximation by use of the descriptor "about," it will be understood that the particular value forms another embodiment. In general, use of the term "about" indicates approximations that can vary depending on the desired properties sought to be obtained by the disclosed subject matter and is to be interpreted in the specific context in which it is used, based on its function. The person skilled in the art will be able to interpret this as a matter of routine. In some cases, the number of significant figures used for a particular value may be one non-limiting method of determining the extent of the word "about." In other cases, the gradations used in a series of values may be used to determine the intended range available to the term "about" for each value. Where present, all ranges are inclusive and combinable. That is, references to values stated in ranges include every value within that range.

It is to be appreciated that certain features of the invention which are, for clarity, described herein in the context of separate embodiments, may also be provided in combination in a single embodiment. That is, unless obviously incompatible or specifically excluded, each individual embodiment is deemed to be combinable with any other embodiment(s) and such a combination is considered to be another embodiment. Conversely, various features of the invention that are, for brevity, described in the context of a single embodiment, may also be provided separately or in any sub-combination. Finally, while an embodiment may be described as part of a series of steps or part of a more general structure, each said step may also be considered an independent embodiment in itself.

Figure 3:
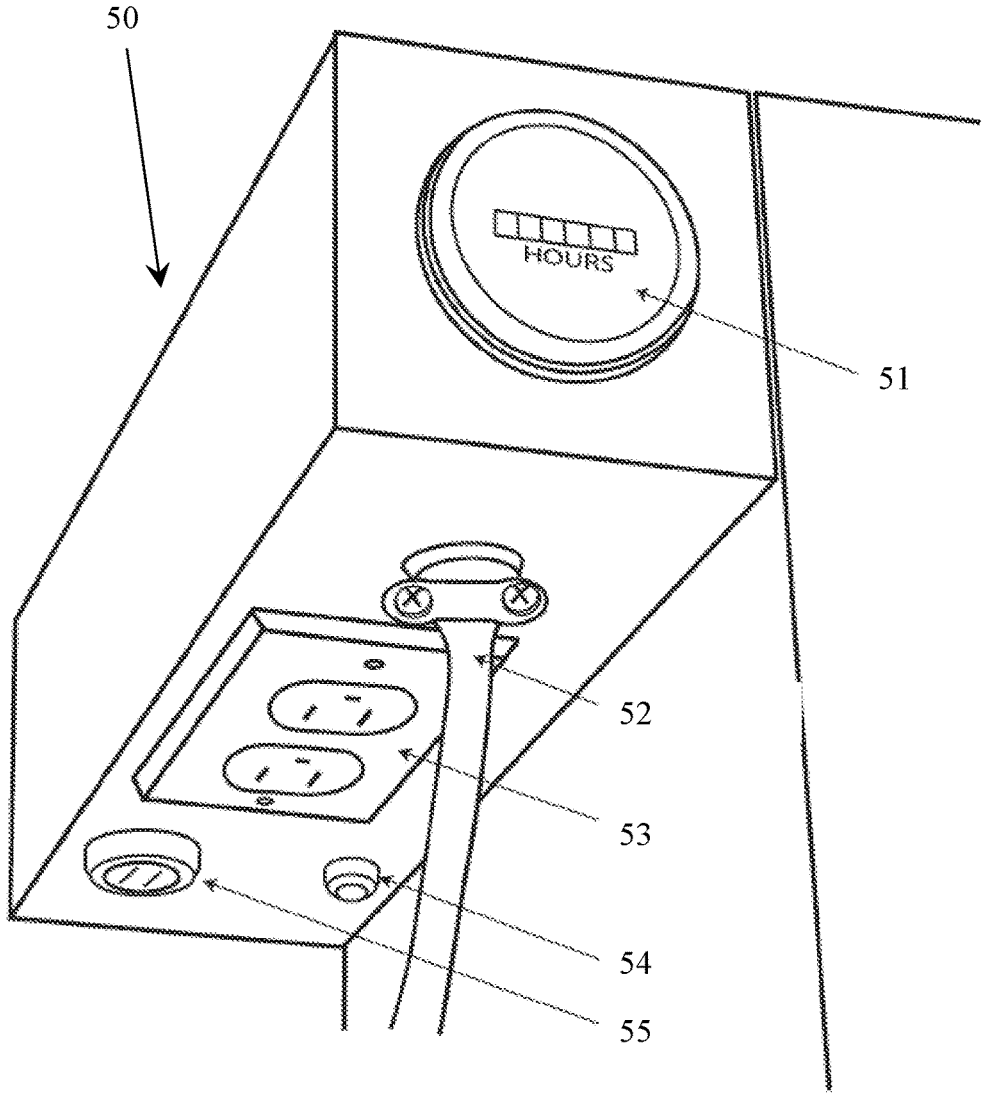
FIG. 3 shows a three-quarter view of one embodiment of control box module of the present invention, showing the control box module 50 (including the features 51-55, described herein)

The present invention(s) are directed to portable cleaning apparatuses adapted for use on mobile cleaning carts, each apparatus comprising:

(a) a vacuum source module 20 comprising a vacuum power unit 22 positioned within an air leak-resistant vacuum source module housing 21, said vacuum source module housing 21 having an inlet portal 23 and an outlet portal 24;

(b) a pre-filter module 30 comprising a primary particle container 32 positioned within an air-leak resistant pre-filter module housing 31, said pre-filter module housing 31 having a debris intake port 33 and an outlet port 35, said primary particle container 32 being releasably attached to the debris intake port 33, and said outlet port 35 of the pre-filter module housing 31 being disposed in fluid communication, preferably direct fluid communication, with the inlet portal 23 of the vacuum source module 20;

(c) a secondary filter module 40 comprising a secondary filter 42 positioned within an air leak-resistant secondary filter module housing 41 having an inlet aperture 44 and an outlet aperture 43, the inlet aperture 44 of said secondary filter module housing 41 being disposed in fluid communication, preferably direct fluid communication, with the outlet portal 24 of said vacuum source module housing 21 so that air is directed to flow from the outlet portal 24 of the vacuum source module housing 21 through the inlet aperture 44 of the secondary filter module housing 41;

(d) the pre-filter module 30 and the vacuum source module 20 being releasably securable to one another; and (e) the vacuum source module 20 and the secondary filter module 40 being releasably securable to one another; and when the (a), (b), and (c) modules are secured together as in (d) and (e), said apparatus, being configured to provide a filtering airflow path, such that an air stream entraining debris, dust and contaminants is directed sequentially through the debris intake port 33, the primary particle container 32, the outlet port 35 of the pre-filter module 30, the inlet and outlet portals 23 and 24 of the vacuum source module housing 21, and the inlet and outlet apertures 44 and 43 of the secondary filter module housing 41; and the apparatus, when energized, providing an A-weighted sound power level of less than about 75 dB, when measured at a distance of 6 feet using a methodology described in ASTM F1334-12. The apparatus may further comprise a separate control box module 50 releasably secured to the vacuum source module 20 and in electrical communication with the vacuum power unit 22, said control box module 50 optionally comprising a motor hour counter 51, electrical outlets with circuit protection 53, circuit protection with optional reset button 54, and low voltage connection 55 (see, e.g., FIG. 3).

Various embodiments provide assemblages in which the modules considered separately and in which the apparatus is partially or wholly assembled. Still other embodiments provide that the assembled apparatus is mounted on or within a mobile cart unit.

Throughout this specification, words are to be afforded their normal meaning, as would be understood by those skilled the relevant art. However, so as to avoid misunderstanding, the meanings of certain terms will be specifically defined or clarified.

For example, the term "air-leak-resistant" means that the modules so-labeled are configured so as to resistant air-leakage during the operation of the apparatus. This may be accomplished by particular attention to sealing points of potential leaks, for example edge joints or connections between the modules.

TABLE

TABLE

List of Features

| Reference Character | Referenced Feature |
|---|---|
| 20 | Vacuum Source Module |
| 21 | Vacuum Source Module Housing |
| 22 | Vacuum Power Unit |
| 23 | Inlet Portal |
| 24 | Outlet Portal |

TABLE-continued

| List of Features | |
|---|---|
| Reference Character | Referenced Feature |
| 25 | Air Relief Valve |
| 26 | Motor |
| 30 | Pre-Filter Module |
| 31 | Pre-Filter Module Housing |
| 32 | Primary Particle Container |
| 33 | Debris Intake Port |
| 34 | Air-Permeable Bag |
| 35 | Outlet Port |
| 40 | Secondary Filter Module |
| 41 | Secondary Filter Module Housing |
| 42 | Secondary Filter |
| 43 | Outlet Aperture |
| 44 | Inlet Aperture |
| 50 | Control Box Module |
| 51 | Motor Hour Counter |
| 52 | Power Cord |
| 53 | Electrical Outlets with Circuit Protection |
| 54 | Circuit Protection with Optional Reset Button |
| 55 | Low Voltage Connection |

In describing the various modules, the terms "portal," "port," and "aperture" are used in connection with the vacuum source module 20, the pre-filter module 30, and the secondary filter module 40, respectively. It should be appreciated that the difference in the descriptors do not necessarily connote a functional or structural differences, but rather are used as a matter of claim convention, to allow the reader to keep track of the associated opening with the relevant module. In fact, in preferred embodiments, the "portals," "ports," and "apertures" have similar constructions and dimensions to allow maximum airflow between the modules and through the apparatus. These openings typically have any shape (e.g., polygonal), though circular is most preferred, with diameter dimensions independently in the range of about 0.5 inches to about 6 inches. Separate embodiments provide independent diameter ranges having a lower limit of about 0.5, about 1, about 2, about 3, and about 4 inches and an upper limited in the range of about 8, about 6, about 5, or about 4 inches.

Where two openings are described herein as being in fluid communication with one another (e.g., "the outlet port 35 of the pre-filter module housing 31 being disposed in fluid communication with the inlet portal 23 of the vacuum source module 20), the reader should interpret the two openings as being configured to allow for the substantially free passage of air therethrough. Where this "fluid communication" is described in terms of "preferably direct fluid communication," the reader should interpret the two openings as being positioned so as to minimize the distance between one another as much as practicably possible. In this case, to the extent physically possible (e.g., but for the presence of an optional gasket between them) the two openings should be abutting one another.

Figure 2:
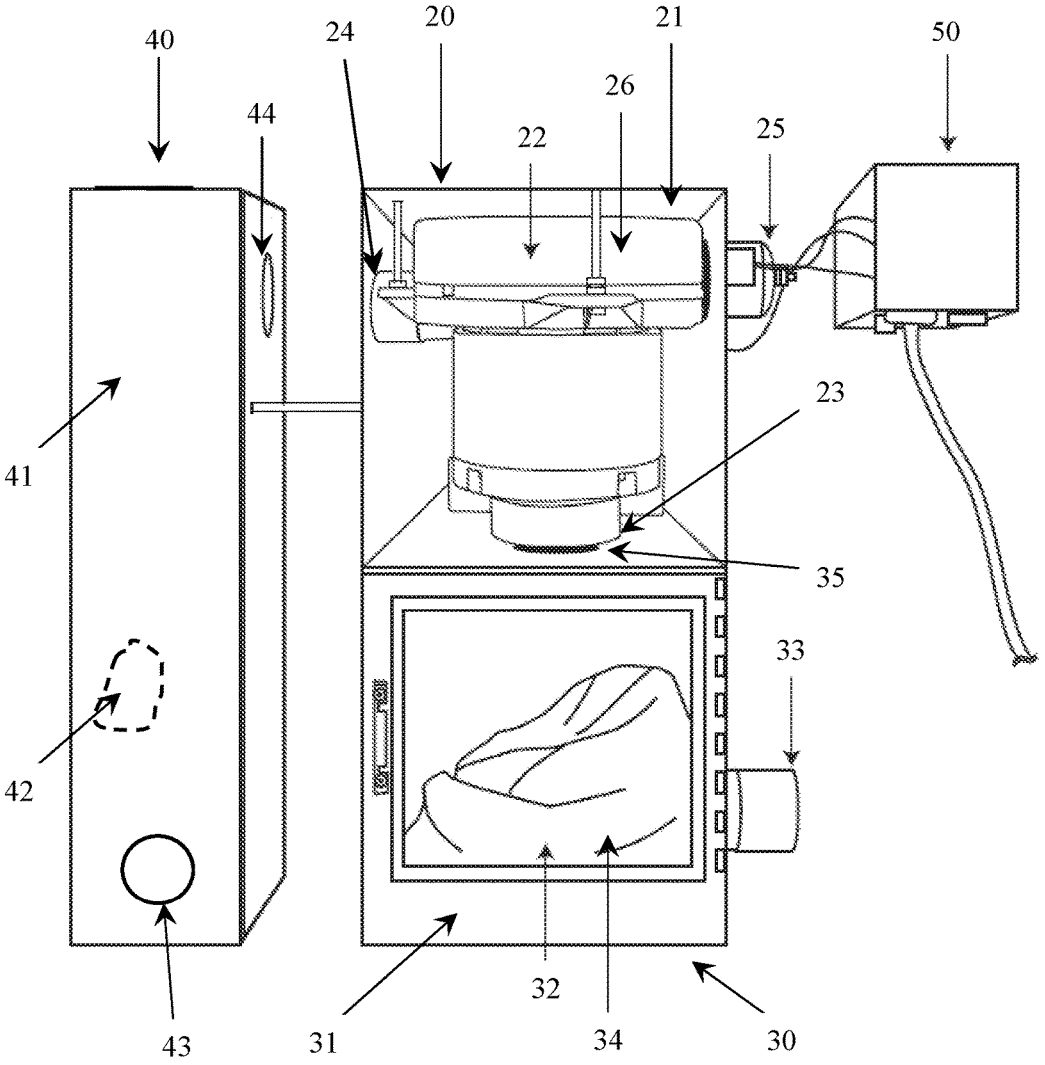
FIG. 2 shows a partially (dis-)assembled embodiment of a vacuum apparatus of the present invention, showing the vacuum source module 20 (including the features 21-26, described herein), pre-filter module 30 (including the features 31-35, described herein), secondary filter module 40 (including the features 41-44, described herein), and control box module 50.
Figure 4:
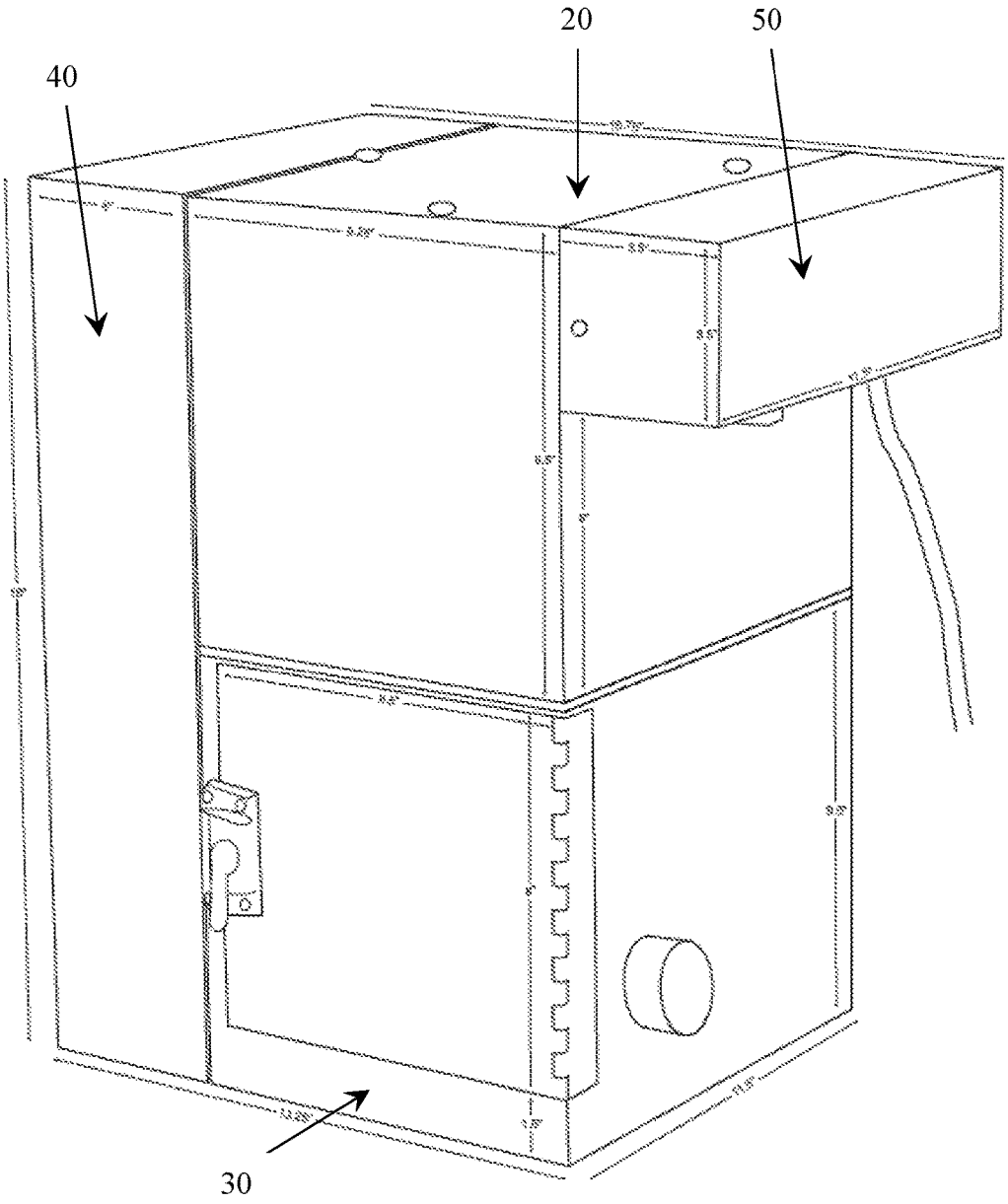
FIG. 4 shows a three-quarter view of one embodiment of an assembled vacuum apparatus of the present invention, showing the vacuum source module 20, pre-filter module 30, secondary filter module 40, and control box module 50.

The vacuum source module 20, the pre-filter module 30, the secondary filter module 40, and the control box module 50 are typically, but not necessarily, each shaped as a substantially a rectangular or cubic prism, where "a substantially rectangular or cubic prism" connotes a shape defined by six sides, each side being shaped substantially as a rectangle or square, allowing for rounded edges. Such shapes confer two related advantages to the modular apparatus over conventional barrel or cylindrical shaped vacuum apparatus; i.e., the ability to stack and arrange the modules and so as to minimize the total footprint space of the assembled device. In various embodiments, the vacuum source module 20 and the pre-filter module 30 are arranged spatially in a vertical orientation with respect to one another. In other embodiments, the vacuum source module 20 is positioned on top of the pre-filter module 30. In still other embodiments, the secondary filter module 40 is positioned adjacent to either one or both of the vacuum source module 20 and the pre-filter module 30. In a preferred embodiment, the vacuum source module 20 is positioned above the pre-filter module 30, and the secondary filter module 40 is positioned adjacent to both, as illustrated in FIGS. 1, 2, and 4. By positioning the vacuum source module 20 above the pre-filter module 30, the vacuum source module 20 (and especially the vacuum power unit 22) is protected from any liquid that may enter the pre-filter module 30 during operation of the apparatus. Also, positioning the secondary filter module 40 adjacent to both the vacuum and pre-filter modules 20 and 30 provides a simple way of maximizing the air flow path through the secondary filter module 40 than other designs might provide.

The present invention is especially useful for providing vacuum cleaning apparatuses that are conveniently adapted for use with mobile hospital cleaning carts. While not constrained to any particular size, in certain embodiments, the total dimensions of the assembled apparatus provide for a total volume of less than 8000 cubic inches (e.g., 20"×20"×20"), less than 4500 cubic inches (e.g., 20"×15'×15"), or less than 3400 cubic inches (e.g., 20"×14"×12") cubic inches. In other independent embodiments, the total assembled apparatus weighs less than about 80 pounds, less than about 60 pounds, less than about 50 pounds, less than about 45 pounds, less than 40 pounds, less than about 35 pounds, less than about 30 pounds, less than about 25 pounds, less than about 20 pounds, or even less than about 15 lbs. The ability to provide the power and cleaning efficiency in such a compact space provides a significant advantage, especially when mounted on or within a mobile cleaning cart, where space is at a premium. By minimizing the space taken by the vacuum apparatus, more space is available in the cart, or the size of the cart can be reduced, or both.

The lightness of weight, small dimensions, and modularity of the apparatus provides additional advantages over conventional cart mounted vacuum cleaners. One such important advantage is the ability to change-out individual modules (for example, to replace damaged parts or to replace clean filters) without the need to replace the entire unit. This ability allows the owner/operator of the apparatus to reduce down-time, maintain lower levels of inventory (e.g., maintain different stock levels for modules or parts, e.g., filters, having different service or maintenance requirements) and, as desired, to ship the individual modules at a lower cost than shipping the entire apparatus.

As described above, the modules are releasably securable to one another, and this "releasable securability" may be achieved using compression fittings fastened from within the modules, cam locking levers, tap bolts with nuts or wing nuts, twist locking, snap-locking, friction, spring-loaded, or hook-latching clamps, or other similar mechanisms. In addition to physically holding the modules together, it is preferred that these mechanisms hold with sufficient integrity as to maintain a seal between the modules, for reasons described below.

Additional embodiments of the present invention provide that the apparatus further comprise sealing gaskets between the pre-filter, vacuum source, and secondary filter modules 30, 20, and 40. That is, in various embodiments, a first gasket is interposed between the outlet port 35 of the pre-filter module 30 and the inlet portal 23 of the vacuum source module 20, said first gasket forming a leak-resistant seal between the pre-filter and vacuum source modules 30 and 20. Similarly, in other embodiments, a second gasket is interposed between the outlet portal 24 of the vacuum source module 20 and the inlet aperture 44 of the secondary filter module 40, said second gasket forming a leak-resistant seal between the vacuum source and secondary filter modules 20 and 40. These first and second gaskets are typically compressible or cushioned pads between the adjoining modules so as to help with air sealing, but also provide the benefit of helping to reduce noise arising from vibration. These first and second gaskets are configured so as to be replaceable and are independently comprised of an EPDM, nitrile rubber, Buna, neoprene, VITON™, silicone, PTFE, PEEK, urethane, or ethylene propylene (EP) copolymer. In preferred embodiments, the first and second gaskets each comprise neoprene.

As described above, certain embodiments provide that the vacuum source module 20 comprises a vacuum power unit 22 positioned within an air leak-resistant vacuum source module housing 21, said vacuum source module housing 21 having an inlet portal 23 and an outlet portal 24. In further embodiments, the vacuum power unit 22 comprises at least one high suction motor 26, including an armature and fan assembly, said motor 26 mounted within the vacuum source module housing 21 and configured to: draw air, from within the vacuum source module 20, through the at least one motor 26 and armature; and exhaust through a motor exhaust horn, said motor exhaust horn configured to direct noise and airflow, preferably directly, through the vacuum source module housing outlet portal 24. A consequence of drawing air from within the vacuum source module 20 (having an air-leak-resistant housing) and exhausting it directly through outlet is that a negative pressure develops within the vacuum source module 20, when the motor 26 is energized. By operating the at least one electric motor 26 inside a negative pressured vacuum source module 20 (i.e., within a vacuum created by the motor 26), the noise of the motor 26 is greatly reduced (since noise does not travel well in a vacuum or partial vacuum). Similar strategies have been described in U.S. Pat. No. 6,804,857 ("the '857 patent") and U.S. Pat. No. 7,690,077, each of which is incorporated by reference herein for all purposes. Each of the motors or configurations described in these patents, as adapted according to the teaching of the present invention is considered embodiments of the present invention. For example, during development of the present invention, it was surprisingly found that the design of the '857 patent could be modified by removing the "necessary" motor plate between the motor 26 and the filter. Normally the motor 26 would be bolted on one side of the plate and the filter would be on the other side. The present "modular" design allows the two independent pieces (motor housing and filtration area) to be more fluid with each other, thereby allowing a reduction in the size of the total apparatus.

It is noted that the description of the mounting is not meant to limit the orientation of the motor 26/armature with respect to the vacuum source module 20. As described below, in a preferred embodiment, the vacuum source module 20 sits above the pre-filter module 30 so as to minimize possibility that liquid (e.g., from leaking pre-filter module 30) does not drain into the motor 26. In such cases, it is preferred that the motor 26/armature be attached to the top of the vacuum source module 20, with armature directed downward. However, other embodiments provide that the vacuum source module 20 may be positioned below or next to the pre-filter module 30, in which case, the pre-filter module 30 may be positioned above the motor 26 and armature. In such cases, the positional descriptors may be interpreted accordingly, such that the motor 26/armature may be mounted to any wall of the vacuum source module 20 to provide optimal arrangement within said vacuum source module 20.

The vacuum which arises within the vacuum source module 20 as a result of the present design provides additional advantages, beyond noise control. For example, by maintaining a negative pressure within the vacuum source module 20 during operation, any particulate that passes through this module from the pre-filter module 30, is retained within the vacuum source module 20 and forced to pass into the secondary filter module 40. In preferred embodiments, all of the air passing through the vacuum source modules 20 ultimately passes into the secondary filter module 40. This is a significant advantage over conventional vacuum units. This eliminates (or at least greatly reduces) egress of particles from the vacuum source module 20, and allows for the entire apparatus to achieve HEPA or ULPA rating (see further below). Similarly, by exhausting the airflow through a motor exhaust horn and, preferably directly, through the vacuum source module housing outlet portal 24 to the secondary filter module 40, any motor debris which may be generated from within the motor 26, such as carbon dust from the motor brushes which are designed to wear away, will pass directly out of the vacuum modules and will be trapped in the secondary filter 42. Such motor debris will not accumulate in the vacuum source module 20 or, worse, leak out of the vacuum source module 20 to the ambient environment.

As described above, the apparatus comprises a pre-filter module 30 comprising, inter alia, a primary particle container 32 positioned within a pre-filter module housing 31. The purpose of this primary particle container 32 is to provide a trap for larger debris, and prevent such larger debris from entering the vacuum source module 20, where it would otherwise damage the vacuum power unit 22. Such "larger debris" may be characterized as having a dimension of greater than a micron, but includes larger particles having dimensions of tens or hundreds of microns, millimeters, or even centimeters (including, e.g., gravel or coins). In independent embodiments, the pre-filter module 30 is configured to remove particle debris having dimensions greater than about 1, 5, 10, 50, 100, or about 500 microns, or about 1 or about 5 millimeter, or about 1 or about 5 centimeter. The size of particles captured by the apparatus is actually limited at the upper end of size by the ability of the debris particle to pass through the debris intake port 33, or any hose attached thereto.

In preferred embodiments, this primary particle container 32 is an air-permeable bag 34, releasably attached to the debris intake port 33. The air-permeable bag 34 is preferably constructed of material capable of withstanding the impact of the larger debris described in the previous paragraph which is injected into the bag 34 through the debris intake port 33 by the vacuum suction.

In other preferred embodiments, the pre-filter module 30 further comprises a porous spacer positioned adjacent to the outlet port 35 of the pre-filter module 30. Such a spacer may comprise a three-dimensional screen or foamed mesh sheet, but should be configured so as to not substantially interfere with the free flow of air between the pre-filter and vacuum source modules 30 and 20. This porous spacer serves at least two independent functions. Its main purpose, which is particularly useful when the primary particle container 32 is a bag 34, is to prevent the primary particle container 32 from blocking the conduit defined by the meeting of the pre-filter outlet port 35/inlet portal 23, and allowing free flow of air through this conduit. A secondary purpose of this spacer is to provide a safety "net" that can capture large debris particles which may arise from any unexpected rupture of the primary particle container 32.

So as to facilitate changing of the primary particle container 32 (e.g., the bag 34), the pre-filter module 30 additionally comprises a resealable opening (a door), so as to allow access to the inside of the pre-filter module 30 (e.g., to clean) and to change the primary particle container 32 (e.g., the bag 34). Preferably, at least a portion of this resealable opening is transparent or translucent to allow a user to view inside the pre-filter module 30 during operation of the apparatus.

As apparatuses of this invention may be used in hospital environments, where the vacuum apparatus will capture biomaterials, including bacteria, fungi, and spores. In various embodiments, the primary particle container 32 and the porous spacer are treated with a biocide, for example a bactericide or fungicide.

Embodiments of the present invention provide that at least one of the pre-filter, vacuum source, and secondary filter modules 30, 20, and 40 comprise at least one acoustic baffle. Such materials are known in the art and need not be iterated here. However, the present inventors have discovered that inclusion of acoustic baffles in the pre-filter module 30 is especially important to maintaining low noise during the operation of the apparatus.

As described above, embodiments of the present invention comprise a secondary filter module 40 comprising a secondary filter 42 positioned within a secondary filter module housing 41 having an inlet aperture 44 and an outlet aperture 43, the inlet aperture 44 of said secondary filter module housing 41 being disposed in fluid communication, preferably direct fluid communication, with the outlet portal 24 of said vacuum source module housing 21 so that air is directed to flow from the outlet portal 24 of the vacuum source module housing 21 through the inlet aperture 44 of the secondary filter module housing 41. The secondary filter module 40 is configured to maximize the contact time between the air flow and the secondary filter 42, and various embodiments contemplate both single and multi-pass configurations. The inlet and outlet apertures 44 and 43 are positioned so as to accommodate these various designs. For example, in a single pass (once-through) system, the outlet aperture 43 is preferably located at or near the end opposite that of the inlet aperture 44; e.g., where the inlet aperture 44 is located at or near the top of the secondary filter module housing 41, as shown in FIG. 2, the outlet aperture 43 is preferably located at or near the bottom of the secondary filter module 40.

In various embodiments, the secondary filter 42 comprises a HEPA ("high efficiency particulate air") filter. As defined by the United States Department of Energy (DOE-STD 3020-2005), a HEPA filter must be capable of removing 99.97% of all particles greater than 0.3 micrometer from the air that passes through. In other embodiments, the secondary filter 42 comprises an ULPA ("ultra-low penetration air") filter. An ULPA filter is defined by the DOE as being capable of removing at least 99.999% of dust, pollen, mold, bacteria and any airborne particles with a size of 120 nanometers (0.12 micron) or larger. A number of recommended practices have been written by the Institute of Environmental Sciences and Technology on testing ULPA filters including IEST-RP-CC001*: HEPA and ULPA Filters*, IEST-RP-CC007*: Testing ULPA Filters*, IEST-RP-CC022*: Testing HEPA and ULPA Filter Media*, and IEST-RP-CC034*: HEPA and ULPA Filter Leak Tests*, each of which is incorporated by reference herein.

It is notable that HEPA and ULPA are defined in terms of the air that passes through the filter. However, using the techniques and features highlighted in this specification, the present invention also includes embodiments in which the entire apparatus is compliant with HEPA or ULPA standards. That is, in certain embodiments, when the modules are taken together, the apparatus is configured so as to be able to remove 99.97% of all particles greater than 0.3 micrometer from the air that enters through the debris intake port 33 (i.e., less than 0.03% of all particles greater than 0.3 micrometers, that enter the debris intake port 33, exit the entire apparatus, from any point). In other embodiments, the apparatus is able to remove at least 99.999% of dust, pollen, mold, bacteria and any airborne particles with a size of 120 nanometers (0.12 micron) or larger that pass through the debris intake port 33 (i.e., less than 0.0001% of particles of the specified size, that enter the apparatus through the debris intake port 33 exit, the entire apparatus, for any point).

Whereas the pre-filter module 30 is capable of removing the larger debris, the secondary filters 42 remove the smaller particles sizes; i.e., less than one micron in size. Particles of this dimension include those comprising bacteria, viruses, and/or spores, including those bio-agents which are a source of nosocomial infections. In certain embodiments, the apparatus is capable of removing sources of these nosocomial infections, thereby reducing the risk of such infections. Representative nosocomial infections for which the risk is reduced include ventilator associated pneumonia (VAP), tuberculosis, hospital-acquired pneumonia (HAP), gastroenteritis, or Legionnaires' disease and where the bacteria or virus comprises *Staphylococcus aureus*, Methicillin resistant *Staphylococcus aureus* (MRSA), *Candida albicans, Pseudomonas aeruginosa, Acinetobacter baumannii, Stenotrophomonas maltophilia, Clostridium difficile*, Vancomycin-resistant *Enterococcus* (VRE), *Legionella pneumophila*, adenovirus, cytomegalovirus (CMV), enterovirus, parechovirus, influenza, parainfluenza virus, respiratory syncytial virus (RSV), rotavirus, rhinovirus, rubella infection, rubeola, or varicella zoster virus.

As described above, the apparatus is configured so as to provide, when energized, an A-weighted sound power level of less than about 75 dB, when measured at a distance of 6 feet using a methodology described in ASTM F1334-12. In further additional independent embodiments, the modules are configured to provide an apparatus which, when energized provides an A-weighted sound power level of less than about 70 dB, less than about 65 dB, less than about 60 dB, less than about 55 dB, or less than about 50 dB, under these same measurement conditions.

In other embodiments, when taken together, the modules are configured to provide an apparatus which, when energized, provides a suction at the debris intake able to support a column of water of at least about 100 inches, when tested according to ASTM F820-06, which is incorporated by reference herein. In some independent embodiments, the apparatus is configured to provide a suction at the at the debris intake able to support a column of water of at least about 105, 110, 115, 120, 125, 130, 135, or about 140 inches, when tested according to ASTM F820-06 Note that the ability to generate a strong vacuum suction is not necessarily equivalent to the ability to generate a large volume vacuum. In fact, for the intended purposes, the former is generally seen to be significantly more important than the latter.

Any of the apparatuses described herein may further comprise an extensible vacuum hose fluidicly coupled to said debris intake port 33 of said pre-filter module 30. While the length of the hose is not particularly limited, in various embodiments it has a length of about 50 feet or less, about 40 feet or less, or about 30 feet or less. In other embodiment, the extensible vacuum hose is coated with a microbiostatic agent, either inside and/or preferably outside of the hose. Such coating materials are known in the art. In still other embodiments, the vacuum hose comprises a sound dampening material, for example, a foamed polymer.

To this point, the apparatus has been described in terms of the apparatus by itself, albeit adapted for use on a mobile cleaning cart. However, other embodiments provide that any one of the apparatuses described herein is actually mounted on or within a mobile cart system for use in hospital environments. Such mobile carts are those at least having wheels, but may also be configured to carry cleaning supplies, vacuum tools, and/or trash receptacles, and/or further comprise a hose reel mechanism assembly for managing any hose which may be attached to the apparatus.

It is contemplated that the apparatus, either alone or as mounted onto or within a mobile cart will be used to clean hospital rooms or other institutional spaces (e.g., schools, churches, or hotel rooms). Accordingly, various embodiments of the present invention include those methods of a cleaning hospital or other institutional spaces, each method comprising vacuuming said room using any apparatus or cart assembly described herein.

U.S. patent application Ser. No. 13/154,290 ("the '290 application"), which is incorporated by reference herein for all purposes, describes cart configurations and methods of cleaning which may be able to take advantage of the unique features of the apparatuses and mobile cart assemblies described herein. Those improvements which are available as a resulting from the combined teachings of the '290 application and the present disclosure are deemed to be additional embodiments within the scope of the present invention.

The following listing of embodiments in intended to complement, rather than displace or supersede, the previous descriptions.

Embodiment 1. A portable cleaning apparatus adapted for use on a mobile cleaning cart, said apparatus comprising:

(a) a vacuum source module 20 comprising a vacuum power unit 22 positioned within an air leak-resistant vacuum source module housing 21, said vacuum source module housing 21 having an inlet portal 23 and an outlet portal 24;

(b) a pre-filter module 30 comprising a primary particle container 32 positioned within an air-leak-resistant pre-filter module housing 31, said pre-filter module housing 31 having a debris intake port 33 and an outlet port 35, said primary particle container 32 being releasably attached to the debris intake port 33, and said outlet port 35 of the pre-filter module housing 31 being disposed in fluid communication with the inlet portal 23 of the vacuum source module 20;

(c) a secondary filter module 40 comprising a secondary filter 42 positioned within an air-leak-resistant secondary filter module housing 41 having an inlet aperture 44 and an outlet aperture 43, the inlet aperture 44 of said secondary filter module housing 41 being disposed in fluid communication with the outlet portal 24 of said vacuum source module housing 21 so that air is directed to flow from the outlet portal 24 of the vacuum source module housing 21 through the inlet aperture 44 of the secondary filter module housing 41;

said apparatus, being configured to provide a filtering airflow path, such that an air stream entraining debris, dust and contaminants is directed sequentially through the debris intake port 33, the primary particle container 32, the outlet port 35 of the pre-filter module 30, the inlet and outlet portals 23 and 24 of the vacuum source module housing 21, and the inlet and outlet apertures 44 and 43 of the secondary filter module housing 41; and the apparatus, when energized, providing an A-weighted sound power level of less than about 75 dB, when measured at a distance of 6 feet using a methodology described in ASTM F1334-12.

Embodiment 2. The apparatus of Embodiment 1, wherein the vacuum source module 20 and the pre-filter module 30 are arranged spatially in a vertical orientation with respect to one another.

Embodiment 3. The apparatus of Embodiment 2, wherein the vacuum source module 20 is positioned on top of the pre-filter module 30.

Embodiment 4. The apparatus of Embodiment 2, wherein the secondary filter module 40 is positioned to be adjacent to either one or both of the vacuum source module 20 and the pre-filter module 30.

Embodiment 5. The apparatus of any one of the preceding Embodiments, wherein the vacuum power unit 22 comprises:

at least one high suction motor 26, including an armature and fan assembly, said motor 26 mounted within the vacuum source module housing 21 and configured to:

(a) draw air, from within the vacuum source module 20, through the at least one motor 26 and armature; and (b) exhaust through a motor exhaust horn, said motor exhaust horn configured to direct noise and airflow through the vacuum source module housing outlet portal 24.

Embodiment 6. The apparatus of any one of the preceding Embodiments, wherein the primary particle container 32 is an air-permeable bag 34.

Embodiment 7. The apparatus of any one of the preceding Embodiments, wherein the pre-filter module 30 further comprises at least one thermal and/or acoustic baffle.

Embodiment 8. The apparatus of any one of the preceding Embodiments, wherein the pre-filter module 30 further comprises a porous spacer positioned adjacent to the outlet port 35 of the pre-filter module 30.

Embodiment 9. The apparatus of Embodiment 8, wherein the porous spacer is a foamed mesh plastic disk.

Embodiment 10. The apparatus of any one of the preceding Embodiments, further comprising:

(a) a first gasket interposed between the outlet port 35 of the pre-filter module 30 and the inlet portal 23 of the vacuum source module 20, said first gasket forming a leak-resistant seal between the pre-filter and vacuum source modules 30 and 20; and (b) a second gasket interposed between the outlet portal 24 of the vacuum source module 20 and the inlet aperture 44 of the secondary filter module 40, said second gasket forming a leak-resistant seal between the vacuum source and secondary filter modules 20 and 40.

Embodiment 11. The apparatus of Embodiment 10, wherein the first and second gaskets are independently comprised of an EPDM, nitrile rubber, Buna, neoprene, VITON™, silicone, PTFE, PEEK, urethane, or ethylene propylene (EP) copolymer.

Embodiment 12. The apparatus of Embodiment 10, wherein the first and second gaskets each comprise a neoprene.

Embodiment 13. The apparatus of any one of the preceding Embodiments, wherein the secondary filter 42 comprises a HEPA filter.

Embodiment 14. The apparatus of any one of the preceding Embodiments, wherein the secondary filter 42 comprises an ULPA filter.

Embodiment 15. The apparatus of any one of the preceding Embodiments, wherein the pre-filter module 30 is configured to remove particle debris having dimensions greater than about 5 microns.

Embodiment 16. The apparatus of any one of the preceding Embodiments, wherein the primary particle container 32 is treated with a bactericide or fungicide.

Embodiment 17. The apparatus of any one of the preceding Embodiments, constructed such that, when the vacuum power unit 22 is energized, can remove 99.97% of all particles having a dimension greater than 0.3 micrometer, as defined by U.S. Department of Energy DOE-STD-3020-2005, which enter through the debris intake port 33, are removed.

Embodiment 18. The apparatus of Embodiment 1, constructed such that, when the vacuum power unit 22 is energized, 99.999% of particles having a dimension of 0.12 micron or greater, as defined by U.S. Department of Energy DOE-STD-3020-2005, which enter through the debris intake port 33, are removed.

Embodiment 19. The apparatus of Embodiment 17 or 18, wherein the particles comprise bacteria or viruses or both bacteria and viruses.

Embodiment 20. The apparatus of Embodiment 19, wherein the bacteria or viruses are a source of a nosocomial infection.

Embodiment 21. The apparatus of any one of the preceding Embodiments, configured such that when the vacuum power unit 22 is energized, the apparatus emits an A-weighted sound power level of less than about 65 dB, when measured at a distance of 6 feet using any methodology described in ASTM F1334-12.

Embodiment 22. The apparatus of any one of the preceding Embodiments, configured such that, when the vacuum power unit 22 is energized, the apparatus provides a suction pressure at the debris intake capable of supporting a column of water of at least 100 inches, when tested according to ASTM F820-06.

Embodiment 23. The apparatus of any one of the preceding Embodiments, further comprising a control box module 50, releasably secured to the vacuum source module 20 and in electrical communication with the vacuum power unit 22.

Embodiment 24. The apparatus of any one of the preceding Embodiments, further comprising an extensible vacuum hose fluidicly coupled to said debris intake port 33 of said pre-filter module 30.

Embodiment 25. The apparatus of Embodiment 24, wherein the extensible vacuum hose has a length of about 50 feet or less.

Embodiment 26. The apparatus of Embodiment 24 or 25, wherein the extensible vacuum hose is coated with a microbiostatic agent.

Embodiment 27. The apparatus of any one of Embodiments 24 to 26, wherein the extensible vacuum hose comprises a sound dampening material.

Embodiment 28. A mobile vacuum cart system for use in hospital environments comprising the apparatus of any one of Embodiments 1 to 27.

Embodiment 29. The cart system of Embodiment 28, further configured to carry cleaning supplies, vacuum tools, and/or trash receptacles.

Embodiment 30. The cart system of Embodiment 28 or 29, further comprising hose reel mechanism assembly.

Embodiment 31. A method of a cleaning hospital room, comprising vacuuming said room with an apparatus of any one of Embodiments 1 to 27.

Embodiment 32. A method of a cleaning hospital room, comprising vacuuming said room with a cart system of any one of Embodiments 28 or 29.

As those skilled in the art will appreciate, numerous modifications and variations of the present invention are possible in light of these teachings, and all such are contemplated hereby. For example, in addition to the embodiments described herein, the present invention contemplates and claims those inventions resulting from the combination of features of the invention cited herein and those of the cited prior art references which complement the features of the present invention. Similarly, it will be appreciated that any described material, feature, or article may be used in combination with any other material, feature, or article, and such combinations are considered within the scope of this invention.

The disclosures of each patent, patent application, and publication cited or described in this document are hereby incorporated herein by reference, each in its entirety, for all purposes.

What is claimed:

1. A portable cleaning apparatus adapted for use on a mobile cleaning cart, said apparatus comprising (a) a vacuum source module comprising a vacuum power unit positioned within an air leak-resistant vacuum source module housing, said vacuum source module housing having an inlet portal and an outlet portal;

(b) a pre-filter module comprising a primary particle container positioned within an air-leak-resistant pre-filter module housing, said pre-filter module housing having a debris intake port and an outlet port, said primary particle container being releasably attached to the debris intake port, and said outlet port of the pre-filter module housing being disposed in fluid communication with the inlet portal of the vacuum source module;

(c) a secondary filter module comprising a secondary filter positioned within an air-leak-resistant secondary filter module housing having an inlet aperture and an outlet aperture, the inlet aperture of said secondary filter module housing being disposed in fluid communication with the outlet portal of said vacuum source module housing so that air is directed to flow from the outlet portal of the vacuum generator housing through the inlet aperture of the secondary filter housing;

said apparatus, being configured to provide a filtering airflow path, such that an air stream entraining debris, dust and contaminants is directed sequentially through the debris intake port, the primary particle container, the outlet port of the pre-filter module, the inlet and outlet portals of the vacuum source module housing, and the inlet and outlet apertures of the secondary filter module housing; and the apparatus, when energized, providing an A-weighted sound power level of less than about 75 dB, when measured at a distance of 6 feet using a methodology described in ASTM F1334-12.

2. The apparatus of claim 1, wherein the vacuum source module and the pre-filter module are arranged spatially in a vertical orientation with respect to one another.

3. The apparatus of claim 2, wherein the vacuum source module is positioned on top of the pre-filter module.

4. The apparatus of claim 2, wherein the secondary filter module is positioned to be adjacent to either one or both of the vacuum source module and the pre-filter module.

5. The apparatus of claim 1, wherein the vacuum power unit comprises:

at least one high suction motor, including an armature and fan assembly, said motor mounted within the vacuum source module housing and configured to:

(a) draw air, from within the vacuum source module, through the at least one motor and armature; and (b) exhaust through a motor exhaust horn, said motor exhaust horn configured to direct noise and airflow through the vacuum source module housing outlet portal.

6. The apparatus of claim 1, wherein the primary particle container is an air-permeable bag.

7. The apparatus of claim 1, wherein the pre-filter module further comprises at least one thermal and/or acoustic baffle.

8. The apparatus of claim 1, wherein the pre-filter module further comprises a porous spacer positioned adjacent to the outlet port of the pre-filter module.

9. The apparatus of claim 8, wherein the porous spacer is a foamed mesh plastic disk.

10. The apparatus of claim 1, further comprising:

(a) a first gasket interposed between the outlet port of the pre-filter module and the inlet portal of the vacuum source module, said first gasket forming a leak-resistant seal between the pre-filter and vacuum source modules; and (b) a second gasket interposed between the outlet portal of the vacuum source module and the inlet aperture of the secondary filter module, said second gasket forming a leak-resistant seal between the vacuum source and secondary filter modules.

11. The apparatus of claim 10, wherein the first and second gaskets are independently comprised of an ethylene propylene diene terpolymer (EPDM), nitrile rubber, Buna, neoprene, a copolymer comprising hexafluoropropylene (HFP) and vinylidene fluoride, silicone, polytetrafluoroethylene (PTFE), polyether ether ketone (PEEK), urethane, or ethylene propylene (EP) copolymer.

12. The apparatus of claim 10, wherein the first and second gaskets each comprise a neoprene.

13. The apparatus of claim 1, wherein the secondary filter comprises a high efficiency particulate air (HEPA) filter.

14. The apparatus of claim 1, wherein the secondary filter comprises a ultra-low penetration air (ULPA) filter.

15. The apparatus of claim 1, wherein the pre-filter module is configured to remove particle debris having dimensions greater than about 5 microns.

16. The apparatus of claim 1, wherein the primary particle container is treated with a bactericide or fungicide.

17. The apparatus of claim 1, constructed such that, when the vacuum power unit is energized, can remove 99.97% of all particles having a dimension greater than 0.3 micrometer, as defined by U.S. Department of Energy DOE-STD-3020-2005, which enter through the debris intake portal, are removed.

18. The apparatus of claim 17, wherein the particles comprise bacteria or viruses or both bacteria and viruses.

19. The apparatus of claim 18, wherein the bacteria or viruses are a source of a nosocomial infection.

20. The apparatus of claim 1, constructed such that, when the vacuum power unit is energized, 99.999% of particles having a dimension of 0.12 micron or greater, as defined by U.S. Department of Energy DOE-STD-3020-2005, which enter through the debris intake portal, are removed.

21. The apparatus of claim 1, configured such that when the vacuum power unit is energized, the apparatus emits an A-weighted sound power level of less than about 65 dB, when measured at a distance of 6 feet using any methodology described in ASTM F1334-12.

22. The apparatus of claim 1, configured such that, when the vacuum power unit is energized, the apparatus provides a suction pressure at the debris intake capable of supporting a column of water of at least 100 inches, when tested according to ASTM F820-06.

23. The apparatus of claim 1, further comprising a control box module, releasably secured to the vacuum source module and in electrical communication with the vacuum power unit.

24. The apparatus of claim 1, further comprising an extensible vacuum hose fluidicly coupled to said debris intake portal of said pre-filter module.

25. The apparatus of claim 24, wherein the extensible vacuum hose has a length of about 50 feet or less.

26. The apparatus of claim 24, wherein the extensible vacuum hose is coated with a microbiostatic agent.

27. The apparatus of any one of claims 24-26, wherein the extensible vacuum hose comprises a sound dampening material.

28. A mobile vacuum cart system for use in hospital environments comprising the apparatus of claim 1.

29. The cart system of claim 28, further configured to carry cleaning supplies, vacuum tools, and/or trash receptacles.

30. The cart system of claim 28, further comprising hose reel mechanism assembly.

31. A method of a cleaning hospital room, comprising vacuuming said room with a cart system of claim 28.

32. A method of a cleaning hospital room, comprising vacuuming said room with an apparatus of claim 1.

* * * * *